US010079462B1

(12) United States Patent
Gelina

(10) Patent No.: US 10,079,462 B1
(45) Date of Patent: Sep. 18, 2018

(54) ELECTRICAL COUPLING ADAPTOR

(71) Applicant: Jamey Gelina, Wellington, FL (US)

(72) Inventor: Jamey Gelina, Wellington, FL (US)

( * ) Notice: Subject to any disclaimer, the term of this patent is extended or adjusted under 35 U.S.C. 154(b) by 0 days.

(21) Appl. No.: 15/660,036

(22) Filed: Jul. 26, 2017

(51) Int. Cl.

| | |
|---|---|
| ***H01R 13/44*** | (2006.01) |
| ***H01R 31/06*** | (2006.01) |
| ***H01R 13/50*** | (2006.01) |
| ***H01R 13/639*** | (2006.01) |
| ***H01R 13/52*** | (2006.01) |
| *H01R 24/30* | (2011.01) |
| *H01R 24/22* | (2011.01) |

(52) U.S. Cl.
CPC ..... *H01R 31/06* (2013.01); *H01R 13/501* (2013.01); *H01R 13/5202* (2013.01); *H01R 13/5213* (2013.01); *H01R 13/6395* (2013.01); *H01R 24/22* (2013.01); *H01R 24/30* (2013.01)

(58) Field of Classification Search
CPC ..... H01R 13/6397; H01R 13/447; H01R 13/5213; H01R 13/44; H01R 13/6395
USPC ..... 439/133, 135, 136, 142, 144, 147
See application file for complete search history.

(56) References Cited

U.S. PATENT DOCUMENTS

| | | | | |
|---|---|---|---|---|
| 4,213,667 A * | 7/1980 | Wittes | H01R 13/595 | 439/469 |
| 6,364,673 B1 * | 4/2002 | Lee | H01R 13/4532 | 174/67 |
| 6,769,930 B1 * | 8/2004 | McDevitt, Jr. | H01R 13/6395 | 439/373 |
| 7,911,757 B2 * | 3/2011 | Hsu | H01R 13/6666 | 307/150 |

* cited by examiner

*Primary Examiner* — Phuong Chi T Nguyen
(74) *Attorney, Agent, or Firm* — Gulf Coast Intellectual Property Group

(57) ABSTRACT

An electrical coupling adapter configured to be mounted to an exterior wall of a structure so as to electrically couple a device located externally to the structure with a power source disposed within the interior of the structure. The electrical coupling adapter includes a housing having a first portion and a second portion integrally formed. The first portion of the housing is located adjacent to an exterior wall of a structure to which the electrical coupling adapter is secured. The second portion is configured to be journaled through the exterior wall of the structure. Coupled to the second portion is a cord that is configured to be operably coupled to a power source disposed within the interior of the structure. A receptacle is mounted on the first portion of the housing and is electrically coupled to the cord. The cord and receptacle are configured to be either male or female.

19 Claims, 3 Drawing Sheets

ELECTRICAL COUPLING ADAPTOR

FIELD OF INVENTION

The present invention relates generally to electrical coupling devices, more specifically but not by way of limitation, an electrical coupling adapter that is configured to facilitate an electrical connection between an object requiring electrical power connection that is located exteriorly with respect to a structure wherein the structure includes electrical receptacles disposed within the interior.

BACKGROUND

Many devices such as but not limited to outdoor testing equipment and the like require electrical power for operation. Both commercial and residential structures typically have at least one electrical outlet to provide power for devices that require electricity to operate. The latter, structure type, residential, often have limited availability of electrical outlets. Further, the location of the electrical outlets is often not in the ideal location for the required device and/or task that needs to be accomplished utilizing a device that requires electrical power.

One issue with limited availability of electrical outlets is the high cost of adding electrical outlet capacity to an existing structure. If a new outlet is required to be place on the exterior of a structure, the cost to add a new electrical receptacle can range from hundreds to thousands of dollars depending upon the requirements and complexities involved. The high cost of adding an electrical outlet to a structure often will prohibit the ability for an individual to utilize a device that requires electrical power for operation. Additionally, while utilization of electrical extension can provide a temporary solution, this arrangement cannot be utilized for any length of time as it is unsafe and does not meet code requirements.

Accordingly, there is a need for an electrical coupling adapter that is configured to facilitate a permanent electrical connection between a device that is located outside of a structure wherein the electrical coupling adapter provides an electrical coupling for the device to a power receptacle disposed within the interior of the structure.

SUMMARY OF THE INVENTION

It is the object of the present invention to provide an electrical coupling adapter that is configured to facilitate an electrical connection between a device located outside of a structure to a power receptacle disposed within the interior of the structure.

Another object of the present invention is to provide an electrical coupling adapter that includes a housing wherein the housing has a first portion and a second portion integrally formed.

A further object of the present invention is to provide an electrical coupling adapter that is configured to facilitate an electrical connection between a device located outside of a structure to a power receptacle disposed within the interior of the structure wherein the first portion of the housing is configured to be located adjacent to an exterior wall of a structure to which the electrical coupling adapter is being mounted.

Still another object of the present invention is to provide an electrical coupling adapter wherein the second portion of the housing is integrally formed with the first portion and the second portion is configured to be journaled through an aperture present in the wall of the structure to which the electrical coupling adapter is being mounted.

An additional object of the present invention is to provide an electrical coupling adapter configured to electrically couple a device requiring electrical power to a power source disposed within an interior of a structure wherein the first portion of the housing includes either male and/or female electrical receptacles.

Yet a further object of the present invention is to provide an electrical coupling adapter wherein the second portion of the housing includes an integrated electrical cord and/or a female electrical receptacle.

Another object of the present invention is to provide an electrical coupling adapter that is configured to facilitate an electrical connection between a device located outside of a structure to a power receptacle disposed within the interior of the structure wherein at least the first portion of the housing is weatherproof.

An alternate object of the present invention is to provide a an electrical coupling adapter wherein the housing has disposed therein the necessary electrical wires to facilitate the transmission of electricity intermediate the electrical connections of the first portion of the housing and the second portion of the housing.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
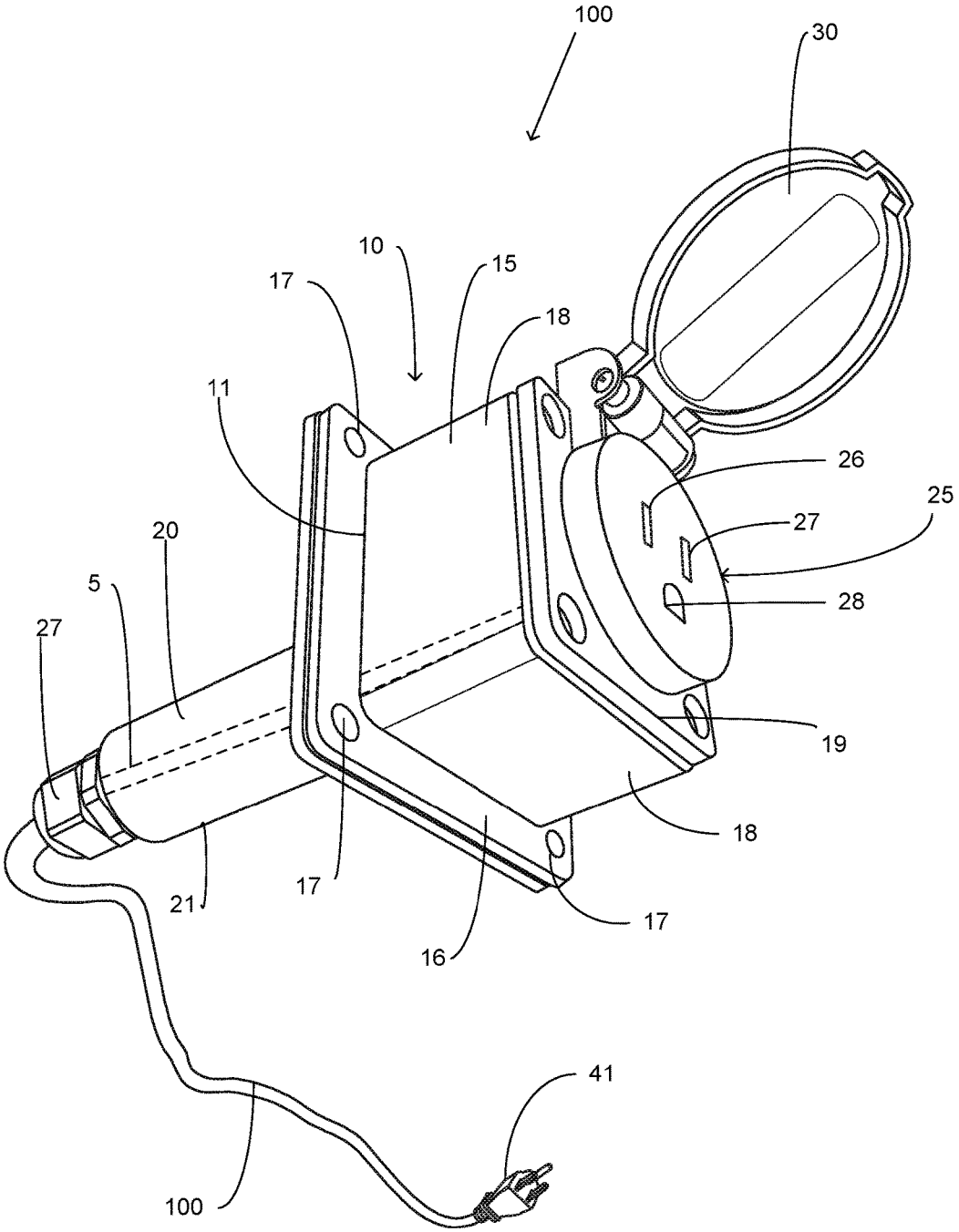
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated an electrical coupling adapter 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
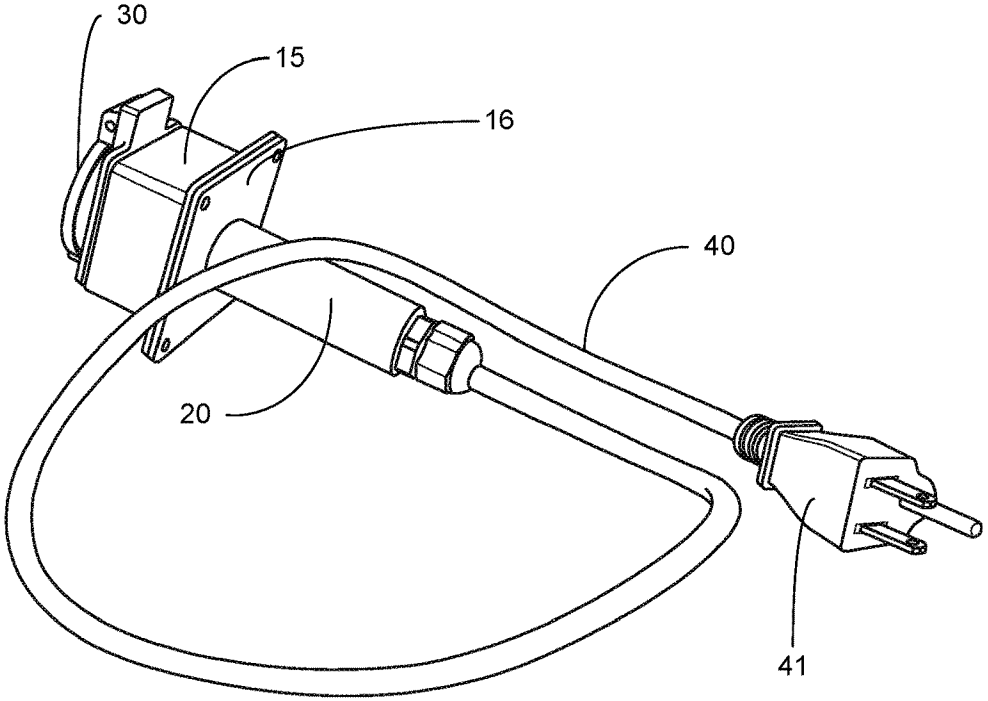
FIG. 3 is a rear side perspective view of an alternative embodiment of the present invention.
Figure 5:
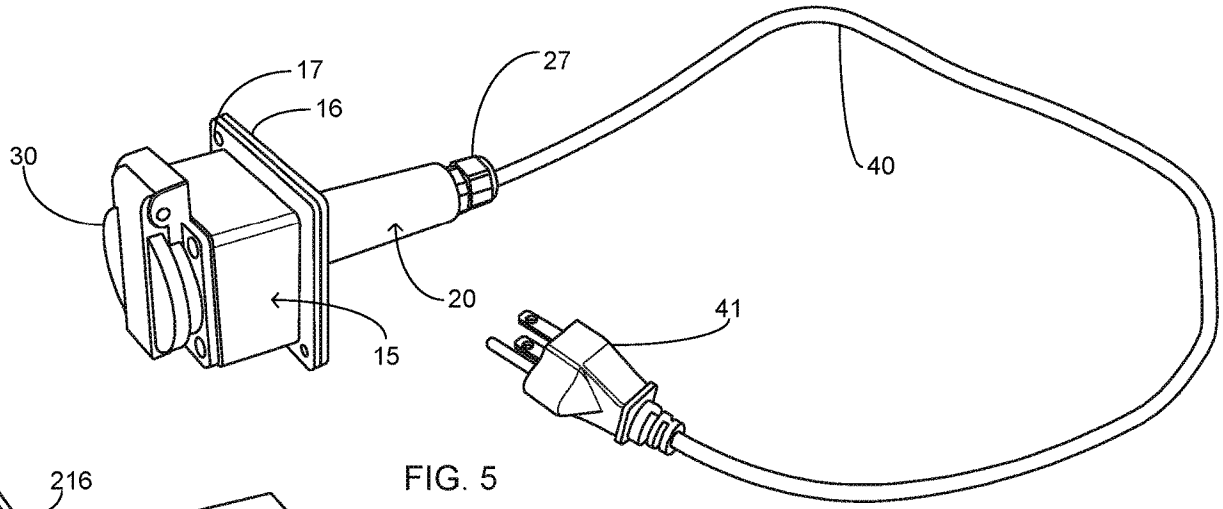
FIG. 5 is a front side perspective view of an alternative embodiment of the present invention.

Referring in particular to FIGS. 1, 3 and 5 an embodiment of the electrical coupling adapter 100 is illustrated therein. The electrical coupling adapter 100 includes housing 10 having first portion 15 and second portion 20. First portion 15 and second portion 20 are integrally formed utilizing suitable durable techniques. The first portion 15 and second portion 20 are manufactured from an insulative weatherproof material such as but not limited to plastic. The first portion 15 of the housing includes base plate 16 that is square in shape. The base plate 16 extends beyond the lower perimeter edge 11 of the first portion 15. Base plate 16 includes a plurality of apertures 17 journaled therethrough that are operable to receive a fastener such as but not limited to a screw. During installation of the electrical coupling adapter 100 the base plate 16 is positioned adjacent an exterior wall of a structure. The apertures 17 receive fasteners therethrough so as to facilitate the securing of the base plate 16 to an exterior wall. The first portion 15 includes a plurality of walls 18 that are integrally formed and operable to create an interior volume. While the base plate 16 and first portion 15 are illustrated herein as being square in shape, it is contemplated within the scope of the present invention that the base plate 16 and first portion 15 could be formed in numerous alternate shapes and sizes.

The first portion 15 further includes a top plate member 19 that is secured to the walls 18. The top plate member 19 is manufactured from the same material as the first portion 15 and is sealably secured thereto so as to inhibit penetration of water into the interior volume of the first portion 15. Secured to the top plate member 19 is receptacle 25. Receptacle 25 is a conventional one hundred and twenty volt receptacle having a hot receiving slot 26, neutral receiving slot 27 and a ground receiving slot 28 configured to mateably connect with a male end of an electrical cord. A cover 30 is hingedly secured to the top plate member 19 and is operable to provide protection from precipitation and the like when the receptacle 25 is not in use.

The second portion 20 of the housing 10 is integrally formed with the base plate 16 and extends outward therefrom. The second portion 20 is cylindrical in shape and has a wall 21 forming an interior volume (not illustrated herein). The second portion 20 is operable to be journaled through a hole that is present or has been manufactured in an exterior wall of a structure. It is contemplated that the diameter of the second portion 20 could vary and further the length thereof could be manufactured to accommodate various different structure wall thicknesses so as to ensure that the second portion 20 has a length that is generally equivalent to or slightly longer than the thickness of the wall in which the second portion 20 is being journaled therethrough.

The second portion 20 functions to journal through an exterior wall of a structure so as to provide the opportunity to electrically couple a power source disposed within the interior of the structure to the cord 40. Cord 40 is secured to the second portion 20 using fastener 27 and is further electrically coupled to the receptacle 25 using internal wire 5. The mounting of the electrical coupling adapter 100 to an exterior wall of a structure such as but not limited a single family residence places the first portion 15 on the exterior wall and the second portion 20 is journaled completely through the exterior wall such that the cord 40 can be electrically coupled with a conventional electrical outlet present within the interior of the structure. Cord 40 includes a male plug 41 that is a conventional male plug operable to be inserted into a conventional female electrical receptacle found in most structures. While a male plug 41 is illustrated in the preferred embodiment herein, it is contemplated within the scope of the present invention that the cord 40 could have a female plug operably coupled thereto. Coupling the male plug 41 to a conventional power source located within the interior of a structure provides the necessary power via wire 5 to receptacle 25 so a user may electrically couple a device to the receptacle 25 for operation thereof. This provides a cost effective alternative to additional electrical wiring for the structure.

Figure 2:
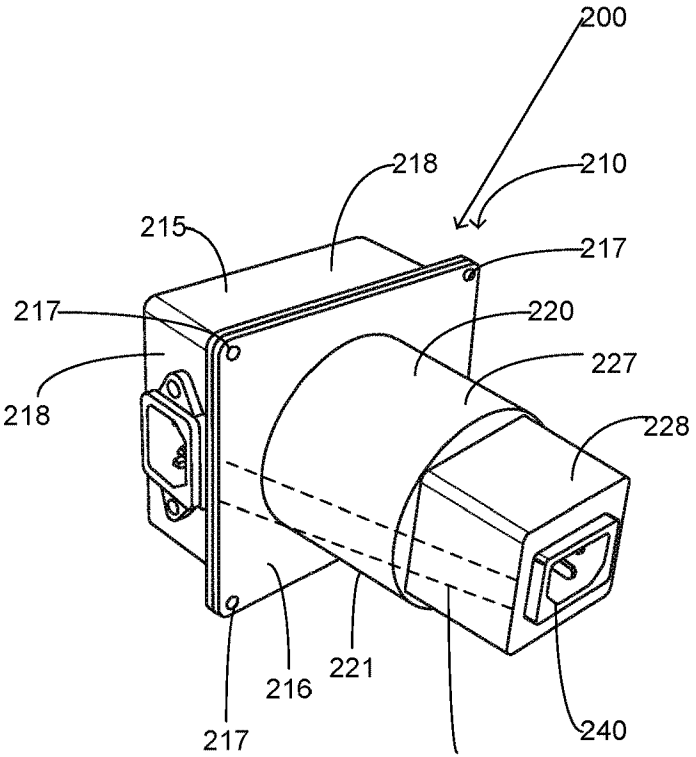
FIG. 2 is a rear side perspective view of an embodiment of the present invention.
Figure 4:
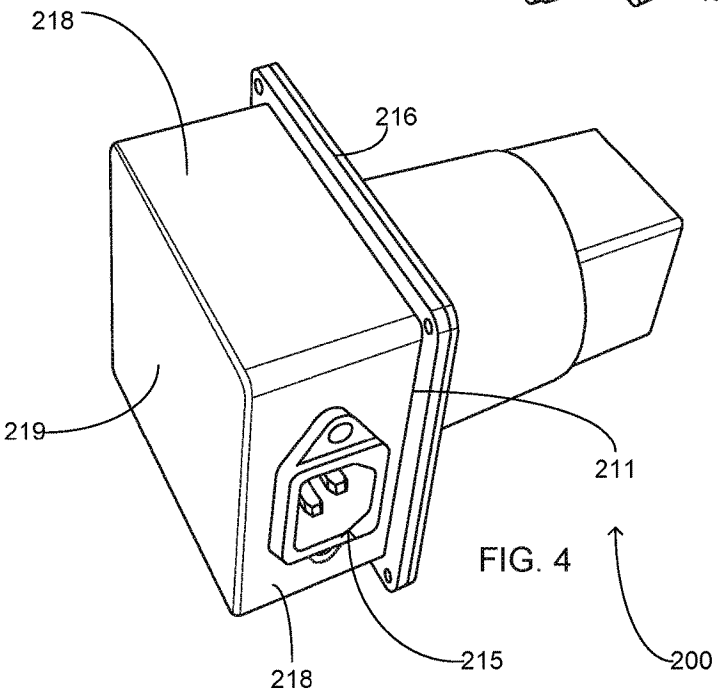
FIG. 4 is a front side perspective view of an embodiment of the present invention.

Referring now to FIGS. 2 and 4, an alternative embodiment of the electrical coupling adapter 200 is illustrated therein. The electrical coupling adapter 200 includes housing 210 having first portion 215 and second portion 220. First portion 215 and second portion 220 are integrally formed utilizing suitable durable techniques. The first portion 215 and second portion 220 are manufactured from an insulative weatherproof material such as but not limited to plastic. The first portion 215 of the housing includes base plate 216 that is square in shape. The base plate 216 extends beyond the lower perimeter edge 211 of the first portion 215. Base plate 216 includes a plurality of apertures 217 journaled therethrough that are operable to receive a fastener such as but not limited to a screw. During installation of the electrical coupling adapter 200 the base plate 216 is positioned adjacent an exterior wall of a structure. The apertures 217 receive fasteners therethrough so as to facilitate the securing of the base plate 216 to an exterior wall. The first portion 215 includes a plurality of walls 218 that are integrally formed and operable to create an interior volume. While the base plate 216 and first portion 215 are illustrated herein as being square in shape, it is contemplated within the scope of the present invention that the base plate 216 and first portion 215 could be formed in numerous alternate shapes and sizes.

The first portion 215 further includes a top plate member 219 that is secured to the walls 218. The top plate member 219 is manufactured from the same material as the first portion 15 and is sealably secured thereto so as to inhibit penetration of water into the interior volume of the first portion 215. Integrally formed into one of the walls 218 is receptacle 225. Receptacle 225 is a conventional one hundred and twenty volt receptacle configured to mateably connect with an end of an electrical cord shaped to matebale couple therewith. It is contemplated within the scope of the present invention that the receptacle 225 could be configured as either a male or female receptacle.

The second portion 220 of the housing 210 is integrally formed with the base plate 216 and extends outward therefrom. The second portion 220 is cylindrical in shape and has a wall 221 forming an interior volume (not illustrated herein). The second portion 220 is operable to be journaled through a hole that is present or has been manufactured in an exterior wall of a structure. It is contemplated that the diameter of the second portion 220 could vary. It is further contemplated that the length of the second portion 220 could be manufactured to accommodate various different structure wall thicknesses so as to ensure that the second portion 220 has a length that is generally equivalent to or slightly longer than the thickness of the wall in which the second portion 220 is being journaled therethrough.

The second portion 220 functions to journal through an exterior wall of a structure so as to provide the opportunity to electrically couple a power source disposed within the interior of the structure to the interior receptacle 240. The second portion 220 includes a first section 227 that is cylindrical in shape and a second section 228 that is square in shape. The first section 227 and second section 228 are integrally formed and the second section 228 is square in shape so as to be mateably coupled with a conventional electrical outlet faceplate for an improved aesthetic installation. Interior receptacle 240 is electrically coupled to the receptacle 225 using internal wire 205. The mounting of the electrical coupling adapter 200 to an exterior wall of a structure such as but not limited a single family residence places the first portion 215 on the exterior wall and the second portion 220 is journaled completely through the exterior wall such that the interior receptacle 240 can be electrically coupled with a conventional electrical cord present within the interior of the structure. It is contemplated within the scope of the present invention that the interior receptacle 240 could be configured as either a male or female plug so as to facilitate an electrical coupling with either a male/female end of an electrical cord. Coupling the interior receptacle 240 to a conventional power source located within the interior of a structure provides the necessary power via wire 205 to receptacle 225 so a user may electrically couple a device to the receptacle 225 for operation thereof. This provides a cost effective alternative to additional electrical wiring for the structure.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An electrical outlet adapter operable to facilitate an electrical connection between a device located externally to a structure and a power source located within an interior of the structure comprising:

a housing, said housing having first portion and a second portion, said first portion and said second portion being integrally formed, said first portion having a plurality of walls, said first portion having a lower perimeter edge;

a base plate, said base plate being intermediate said first portion and said second portion, said base plate being proximate the lower perimeter edge of said first portion, said base plate extending outward from said lower perimeter edge;

a receptacle, said receptacle being mounted in said first portion of said housing distal to said base plate, said receptacle configured to be electrically coupled to a power cord; and a cord, said cord being operably coupled to said second portion of said housing, said cord configured to electrically couple to a power source disposed within the interior of the structure, said cord being electrically coupled to said receptacle.

2. The electrical adapter as recited in claim 1, wherein said second portion of said housing is cylindrical in shape.

3. The electrical adapter as recited in claim 2, wherein said base plate includes a plurality of apertures operable to receive a fastener therethrough so as to secure said base plate to an exterior wall of the structure.

4. The electrical adapter as recited in claim 3, wherein the cord is configured with a female plug.

5. The electrical adapter as recited in claim 3, wherein the cord is configured with a male plug.

6. The electrical adapter as recited in claim 3, wherein the receptacle is a female electrical receptacle.

7. The electrical adapter as recited in claim 3, wherein the receptacle is a male electrical receptacle.

8. An electrical coupling outlet adapter operable to facilitate an electrical connection between a device located externally to a structure and a power source located within an interior of the structure comprising:

a housing, said housing having first portion and a second portion, said first portion and said second portion being integrally formed, said second portion being configured to be journaled through an exterior wall of the structure, said first portion having a plurality of walls, said first portion having a lower perimeter edge;

a base plate, said base plate being intermediate said first portion and said second portion, said base plate being proximate the lower perimeter edge of said first portion, said base plate extending outward from said lower perimeter edge;

a receptacle, said receptacle being mounted in one of said plurality of walls of said first portion, said receptacle configured to be electrically coupled to a power cord; and a interior receptacle, said interior receptacle being operably integrally formed with said second portion of said housing, said interior receptacle being configured to electrically couple to an electrical cord disposed within the interior of the structure, said interior receptacle being electrically coupled to said receptacle.

9. The electrical adapter as recited in claim 8, wherein said second portion of said housing has a length that is equal to or greater than a thickness of the exterior wall to which the electrical coupling adapter is mounted.

10. The electrical adapter as recited in claim 9, wherein said second portion of said housing includes a first section and a second section, said first section and said second section being integrally formed, said first section being cylindrical in shape and said second section being square in shape.

11. The electrical adapter as recited in claim 10, wherein the interior receptacle is configured as either a male receptacle or a female receptacle.

12. The electrical adapter as recited in claim 10, wherein the receptacle is configured as either a male receptacle or a female receptacle.

13. The electrical adapter as recited in claim 10, wherein the receptacle and the interior receptacle are electrically coupled utilizing a wire.

14. The electrical adapter as recited in claim 13, wherein the base plate is adjacent the exterior wall of the structure ensuing the mounting of the electrical coupling adapter to the structure.

15. An electrical coupling outlet adapter operable to facilitate an electrical connection between a device located externally to a structure and a power source located within an interior of the structure wherein a portion of the electrical coupling adapter is configured to be journaled through a hole in an exterior wall of the structure wherein the electrical coupling adapter comprises:

a housing, said housing having first portion and a second portion, said first portion and said second portion being integrally formed, said first portion having a plurality of walls, said first portion being square in shape, said first portion further having a top plate member operably coupled to said plurality of walls, said first portion having a lower perimeter edge, wherein said second portion of said housing has a length that is equal to or greater than a thickness of the exterior wall to which the electrical coupling adapter is mounted;

a base plate, said base plate being intermediate said first portion and said second portion, said base plate being proximate the lower perimeter edge of said first portion, said base plate extending outward from said lower perimeter edge;

a receptacle, said receptacle being mounted in said top plate member of said first portion of said housing distal to said base plate, said receptacle configured to be electrically coupled to a power cord; and a cord, said cord being operably coupled to said second portion of said housing, said cord configured to electrically couple to a power source disposed within the interior of the structure, said cord being electrically coupled to said receptacle.

16. The electrical adapter as recited in claim 15, and further including a cover, said cover being hingedly secured to said top plate member, said cover operable to cover said receptacle.

17. The electrical adapter as recited in claim 16, and further including a wire, said wire configured to electrically couple said receptacle and said cord.

18. The electrical adapter as recited in claim 16, wherein the cord is configured with either a female plug or a male plug.

19. The electrical adapter as recited in claim 18, wherein the receptacle is either a female electrical receptacle or a male electrical receptacle.

* * * * *